US005708926A

United States Patent [19]

Sagara et al.

[11] Patent Number: 5,708,926

[45] Date of Patent: Jan. 13, 1998

[54] IMAGE HEATING APPARATUS WITH FIRST AND SECOND ELASTIC MEMBERS

[75] Inventors: Seiji Sagara, Kawasaki; Nobukazu Adachi, Yokohama, both of Japan

[73] Assignee: Canon Kabushiki Kaisha, Tokyo, Japan

[21] Appl. No.: 606,685

[22] Filed: Feb. 26, 1996

Related U.S. Application Data

[63] Continuation of Ser. No. 193,556, Feb. 8, 1994, abandoned.

[30] Foreign Application Priority Data

Feb. 8, 1993 [JP] Japan ..... 5-043271

[51] Int. Cl.[6] ..... G03G 15/20

[52] U.S. Cl. ..... 399/122; 399/328; 399/329

[58] Field of Search ..... 355/295, 290, 355/285, 282; 399/122, 320, 328, 329, 330, 331; 219/216; 432/60

[56] References Cited

U.S. PATENT DOCUMENTS

| | | | |
|---|---|---|---|
| 4,272,666 | 6/1981 | Collin | 219/216 |
| 4,589,758 | 5/1986 | Kasama et al. | 219/216 X |
| 4,802,439 | 2/1989 | Sugimoto et al. | 118/116 |
| 4,806,970 | 2/1989 | Nakatoni et al. | 355/282 |
| 4,954,845 | 9/1990 | Yano et al. | 355/290 |
| 5,148,226 | 9/1992 | Setoriyama et al. . | |
| 5,149,941 | 9/1992 | Hirabayashi et al. . | |
| 5,253,013 | 10/1993 | Takano et al. | 355/200 |
| 5,262,834 | 11/1993 | Kusaka et al. . | |
| 5,291,256 | 3/1994 | Kitajima et al. | 355/290 |
| 5,300,998 | 4/1994 | Ogisawa et al. | 355/285 |
| 5,532,806 | 7/1996 | Sugita et al. | 399/328 |

*Primary Examiner*—William J. Royer

*Attorney, Agent, or Firm*—Fitzpatrick, Cella, Harper & Scinto

[57] ABSTRACT

An image heating apparatus includes a first member; a second member for forming a nip in cooperation with the first member; a first frame for supporting the first frame a second frame connected to the first member frame rotation about a rotational axis; a first pressing member for pressing the second member toward the first member, away from the second frame; and a second pressing member for applying an additional pressure between the first and second frames so that an additional pressure is applied between the first and second members.

17 Claims, 7 Drawing Sheets

IMAGE HEATING APPARATUS WITH FIRST AND SECOND ELASTIC MEMBERS

This application is a continuation of application Ser. No. 08/193,556, filed Feb. 8, 1994, now abandoned.

FIELD OF THE INVENTION AND RELATED ART

The present invention relates to an image heating apparatus for heating a recording material, in which the recording material is heated as it is passed through a nip formed between a pair of pressing members being pressed to each other.

In an image forming apparatus such as an electrophotographic copying machine, printer, or facsimile, an unfixed toner image is directly formed or indirectly formed on (transferred to) a sheet of material (recording material) in a processing means for image formation, with the use of an appropriate image forming principle and system, in correspondence with the imaging data for a target image, and is thermally fixed by the heating apparatus. As the heating apparatus generally speaking, a thermal fixing apparatus of a heat roller type is commonly used.

This heat roller type heating apparatus comprises a heat roller (fixing roller) as a rotary heating means, and a pressure roller as a rotary opposing (pressing) means, which are pressed to each other by a pressing means, forming a fixing nip (pressure nip), where the sheet of material carrying the unfixed toner image is introduced as a member to be heated. As the sheet is passed through the nip, the unfixed toner image is fixed onto the sheet surface by the heat and pressure from the pair of rollers.

The heat roller generally comprises a piece of aluminum pipe, which is the main structure, in which a halogen heater, for example, is positioned as a heating member. The power supply to the heating member is controlled by a temperature controlling means in such a manner that the temperature of the main structure of the heat roller is maintained at a predetermined high temperature, that is, a fixing temperature.

Generally speaking, as the pressure roller, a roller comprising an iron core and a heat resistant rubber material layer formed over the iron core is employed, and as a means for pressing the heat roller and pressure roller to each other, a pressure generating spring (compression coil spring) is used.

As the heat roller and pressure roller are pressed to each other, the heat resistant rubber material layer of the pressure roller deforms; as a result, a nip is formed in which the surface of the pressure roller comes in contact with the surface of the heat roller. The width of this nip (nip length in the rotational direction of the roller), along with the heating temperature, is critical to guaranteeing the fixing performance. In other words, how to maintain stably a sufficient nip width is one of the critical points in the apparatus design.

In the past, there was a method in which the positional relation between the heat roller and pressure roller was fixed in consideration of the predicted deformation of the rubber material layer of the pressure roller, and another method in which one of the pair of rollers was fixed but the other was mounted on a pressure spring in such a manner that the contact pressure between the pair of roller was adjusted in response to the value calculated in advance based on the relation between the displacement of the spring and the resulting pressure. As far as the stability of the nip width or nip pressure is concerned, the latter using the pressing means comprising the spring is superior in most cases.

In recent years, the heating apparatus of a film heating type has come to be put to practical use as the image fixing thermal apparatus. This type of heating apparatus has been disclosed in U.S. Pat. No. 149,941, U.S. Ser. Nos. 4444,802 and 712,532, and U.S. Pat. No. 5,148,226. In this type of heating apparatus, a heat resistant film is run between a heating means and an opposing (pressing) means, being sandwiched between them, wherein a sheet of material carrying an unfixed toner image is introduced, as the material to be heated, into a nip formed by the heating means and opposing means, with the heat resistant film being interposed, and while the sheet is passed through the nip, being firmly pressed on the heat resistant film, the heat from the heating means is transmitted to the sheet through the heat resistant film, fixing thermally the unfixed toner image onto the sheet surface.

The heating apparatus of such a through-film heating system can use a heating means with a low heating capacity and a thin heat resistant film, the temperatures of which quickly rise; therefore, it has such advantages that it can save electrical power, shorten the wait time (quick startup), reduce the temperature increase in the machine such as the image forming apparatus, and also, it is very effective as the heating apparatus.

As the heating means, a so-called ceramic heater (slid-state heater), comprising basically a heat resistant and electrically insulating ceramic substrate and an exothermic resistive member, is used, and it generates heat as the electrical power is supplied to the resistor.

As the opposing means, a pressure roller like the one used in the heating apparatus of the aforementioned heat roller type, comprising an iron core and a heat resistant rubber layer, is used. As the pressing means for pressing the heater as the heating means and the pressure roller as the opposing means to each other, with the heat resistant film being interposed, a means for pressing them with the use of a pressure spring is generally used in this case also.

Further, in the heating apparatus of this through-film heating apparatus, the heat resistant rubber material layer of the pressure roller deforms due to the pressure generated by the heater and pressure roller pressed to each other with the heat resistant film being interposed, forming thereby a nip n which the surface of the pressure roller conforms to the contour of the heat roller, indirectly through the heat resistant film. The width of this nip is just as critical as it is in the heating apparatus of the heat roller type for guaranteeing the stable heating temperature and the stable fixing performance. In other words, to maintain stably the nip having a sufficient width and a proper form is one of the critical points of the apparatus design.

Generally speaking, the pressure between the heating means and opposing means in the fixing apparatus as the heating apparatus such as the one described above is rather large; for example, the overall pressure is 5 to 10 kg in a small apparatus, and 40 to 60 kg in a large one. When the apparatus is jammed because the sheet of material to be heated has wrapped around the heating means or opposing means, or when the sheet has stuck in the pressure nip between the heating means and opposing means as the apparatus is suddenly stopped, the above-described pressure needs to be released in order to handle the jam. However, in the apparatus using the prior pressure generating system, the above mentioned large pressure cannot be easily released, and in addition, the pressure releasing mechanism is complicated, making it costly, and requires a large strength to operate the mechanism; therefore, it needs a lot of improvements in many ways.

SUMMARY OF THE INVENTION

Accordingly, the principle object of the present invention is to provide an image heating apparatus which allows the pressure of the pressure generating spring to reduced.

Another object of the present invention is to provided an image heating apparatus in which the force necessary to release the pressure is reduced.

According to an aspect of the present invention, the image heating apparatus comprising a first member, a second member for forming a nip in cooperation with said first member, a first frame for supporting said first member, a second frame attached to said first member in a manner to rotate about an axis, a first pressing member for pressing said second member toward said first member, away from said second frame, and a second pressing member for generating an additional pressure between said first and second frame so that subsequent additional pressure is generated between said first and second member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

FIGS. 1 to 4 shows embodiments of the image heating apparatus according to the present invention. In the embodiments, the image heating apparatus, that is, the fixing apparatus, is of a through-film heating type.

Figure 1A:
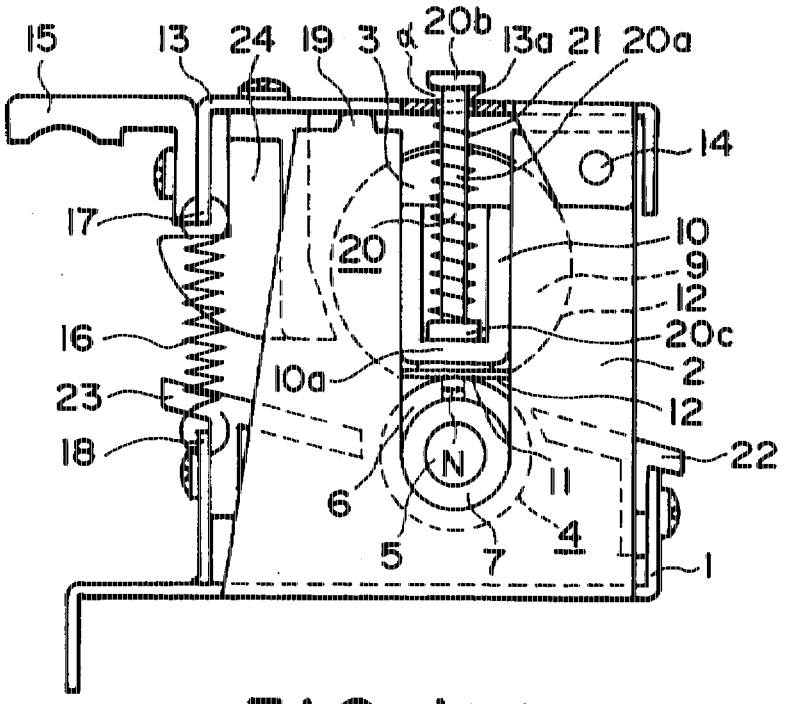
FIGS. 1(*a*) and 1(*b*) are a partially cutaway side view of an embodiment of the apparatus according to the present invention, and a partially cutaway side view of the apparatus in a state in which the pressure has been released.
Figure 1B:
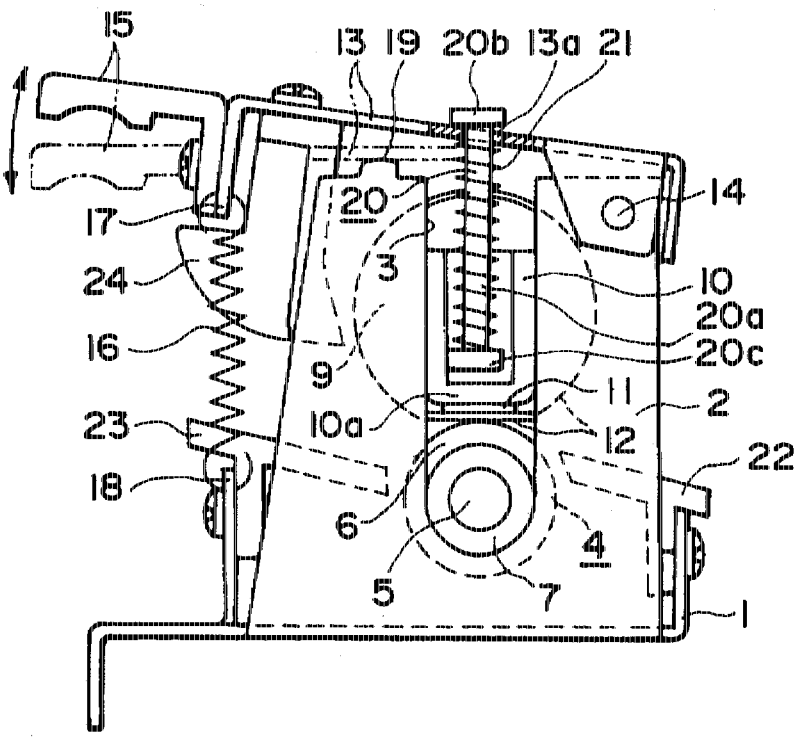
Figure 2:
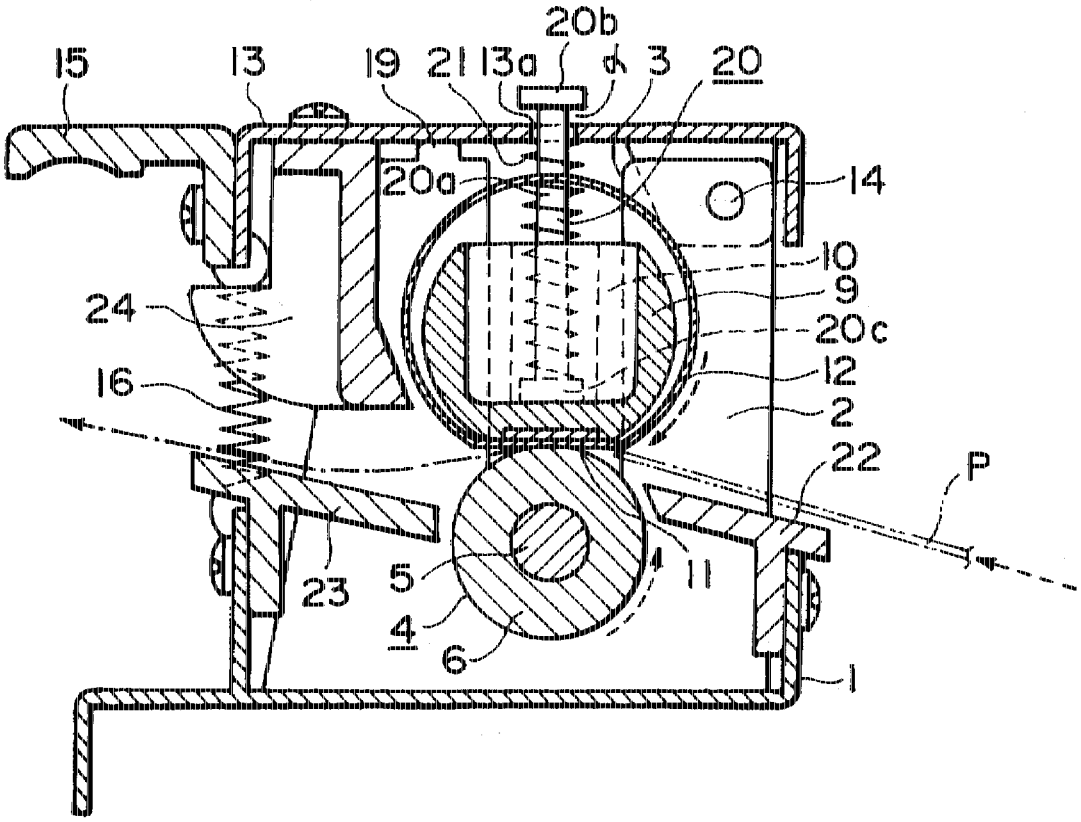
FIG. 2 is a sectional view of the apparatus.
Figure 3:
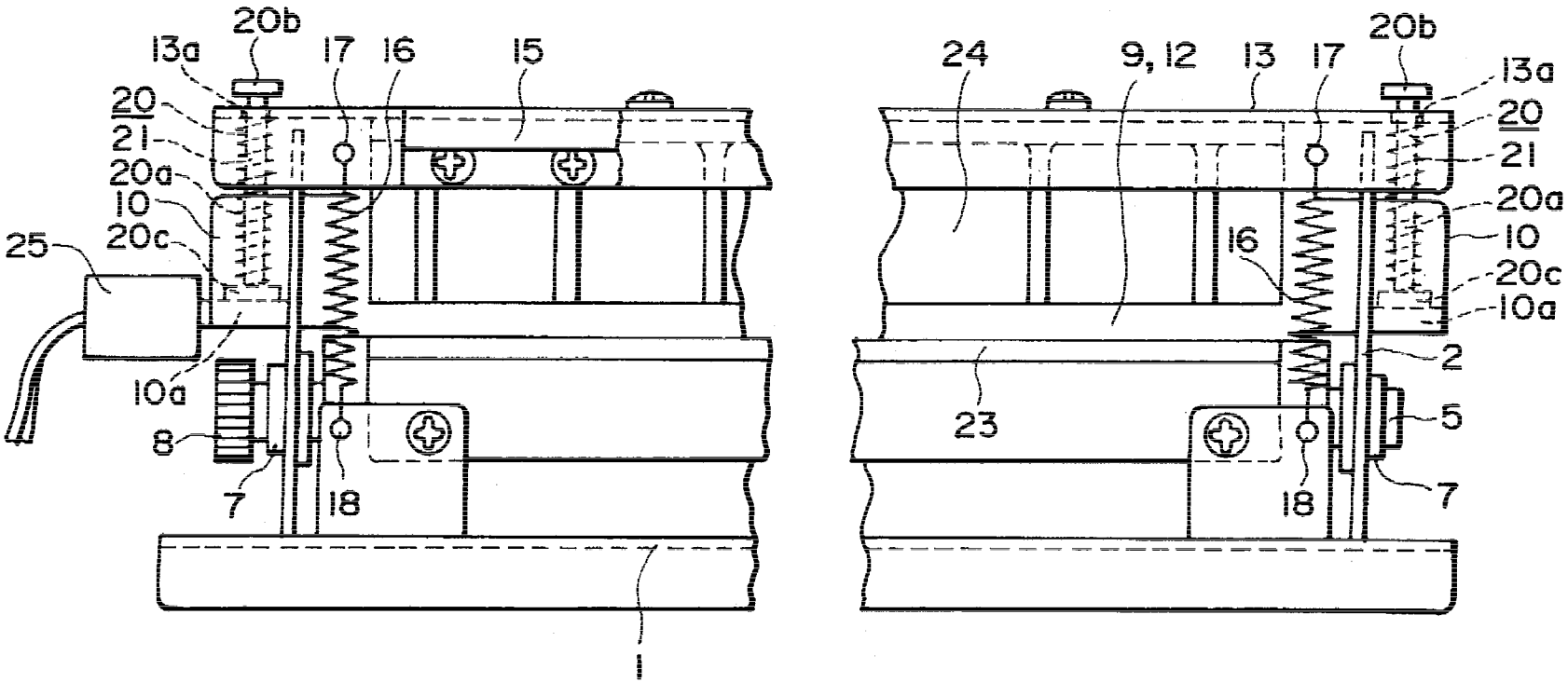
FIG. 3 is a rear view of the apparatus, with the middle portion being omitted.
Figure 4:
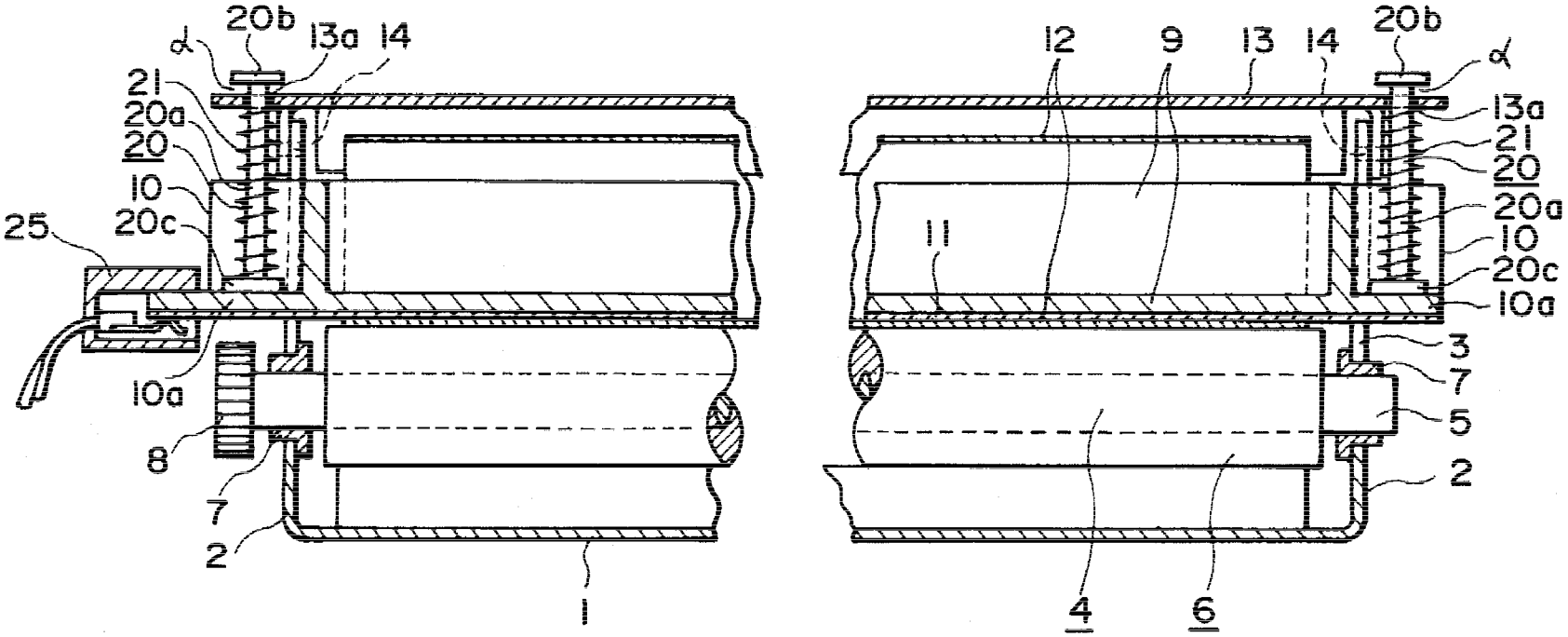
FIG. 4 is a longitudinal section of the rear portion of the apparatus, with the middle portion being omitted.

FIG. 1(*a*) is a partially cutaway side view of the apparatus; FIG. 1(*b*), a partially cutaway side view of the apparatus in a state in which the pressure has been released; FIG. 2, a sectional view of the apparatus; FIG. 3, a rear view of the apparatus with the middle portion being omitted, and FIG. 4 is a longitudinal section of the rear portion of the apparatus with the middle portion being omitted.

A reference numeral 1 designates a frame of the apparatus; 2 and 2, left and right side plates; and reference numerals 3 and 3 are guide grooves cut to extend vertically in the left and right side plate, with the guide groove in the left plate being symmetrical to the one in the right plate. The guides grooves 3 and 3 have open ends at the top surfaces of the respective side plates.

A reference numeral 4 designates a pressure roller as a means opposing a heating means, which comprises a metallic core 5 and a heat resistant rubber material layer 6. At the opposite ends of the metallic core 5, bearings 7 and 7 are attached. These bearings 7 and 7 are engaged into the guide grooves 3 and 3 of the left and right plates 2 and 2 of the frame 1 through the open ends at the top, and are slid down to the bottom ends of the guide grooves, whereby the pressure roller 4 is suspended between the left and right side plates 2 and 2 of the frame 1 being enabled to rotate freely by the bearings 7 and 7. A reference numeral 8 designates a driving gear affixed to one end of the metallic core 5 of the pressure roller 4.

A reference numeral 9 designates an internal film guide stay (guiding member) shaped like a trough, the sectional area of which looks like half a circle, and 10 designates an integrally formed extension of this guide stay 9. On the bottom facing surface of this guide stay 9, a ceramic heater 1 is provided as the heating means in a manner to extend in the longitudinal direction.

A reference numeral 12 designates a tube (endless) of heat resistant film (fixing film) fitted loosely around the guide stay 9 containing the heater 11.

The guide stay 9 containing the heater 11 is assembled into the apparatus by engaging the extensions 10 and 10 at the opposite left and right ends into the guide grooves 3 and 3 of the left and right side plates 2 and 2, and sliding them down toward the bottoms of the left and right side plates 2 and 2 of the frame 1. As the guide stays 9 are assembled into the apparatus, the top portion of the pressure roller 4 which has been previously assembled and the heater 11 provided at the bottom portion of the guide stay 9 come in contact with each other with the heat resistant film 12 being interposed.

A reference numeral 13 designates a pressure plate (pressing member) positioned between the top portions of the left and right side plates 2 and 2 of the apparatus frame 1, in such a manner as to pivot vertically about the rotational axes 14 and 14, and 15 designates a handle (operational member for releasing the pressure) of the pressure plate 13 provided on the side opposite to the rotational axis 14.

Reference numerals 16 and 16 designate set springs stretched between the spring hangers 17 and 17 of the pressure plate 13 and the spring hangers 18 and 18 of the frame 1, which are provided on the left and right sides, respectively, and they are positioned on the side opposite to the rotational axis 14 of the pressure plate 13.

Therefore, the pressure plate 13 is pulled down by the tension of the set springs 16 and 16 in a manner so as to pivot about the rotational axes 14 and 14, up to a point where it comes into contact with stoppers 19 and 19 constituting the upper ends of the left and right side plates 2 and 2, and is held there.

The pressure plate 13 can be pivoted upward, away from the upper ends of the left and right side plates 2 and 2, in a manner so as to rotate about the rotational axes 14 and 14 by grasping and pulling up the handle 15 of the pressure plate 13 against the tension of the set springs 16 and 16, as shown by the solid line in FIG. 1(*b*).

Reference numerals 20 and 20 designate left and right auxiliary pressure generating members. Each of the auxiliary pressure generating members 20 and 20 is positioned between the rotational axis 14 and the set spring 16. The auxiliary pressure generating member 20 is vertically extending rod-like member comprising a shaft portion 20*a* fitted loosely in a hole 13*a* bored in the pressure plate 13 and stoppers 20*b* and 20*c* formed integrally at the top and bottom portions of the shaft portion 20*a*, wherein the diameters of the stoppers 20*b* and 20*c* are larger than that of the hole 13*a*.

Reference numerals 21 and 21 designate left and right pressure generating springs (compression coil spring), being fitted loosely around the shaft portions 20*a* of the auxiliary pressure generating member 20 and compressed (to give an auxiliary pressure) between the pressure plate 13 and bottom stopper 22*c*.

The left and right bottom stoppers 22*c* and 22*c* of the auxiliary pressure generating member 20 are in contact with the respective extensions of the internal film guide stay 9, and when the positional relation between the pressure plate 13 and the frame is such that the pressure plate 13 is in contact with the stopper 19 due to the tension of the set spring 16 as shown in FIGS. 2 to 4, the bottom stopper 20*c* of the auxiliary pressure generating member 20 is in contact with the extension 10 of the guide stay 9; thus, expansive force of the pressure generating spring 21 presses down the auxiliary pressure generating member 20, which in turn presses down the guide stay 9. As the guide stay 9 is pressed down, a pressure is generated between the guide stay 9 and pressure roller 4 with the heat resistant film 12 being interposed; as a result, the beat resistant rubber material layer 6 of the pressure roller 4 is deformed, creating a fixing nip N having a predetermined width in which the surface of the pressure roller 4 conforms to the surface of the heater 11, with the heat resistant film 12 being interposed. Reference numerals 10*a* and 10*a* designate the portions of the guide stay extensions where the bottom stoppers 20*c* and 20*c* of the auxiliary pressure generating member 20 and 20 contact the guide stay 9.

Hereinafter, the state illustrated in FIG. 1(*a*) and FIGS. 2 to 4 will be called the pressure generating state. In this pressure generating state, a gap a is present between the bottom surface of the upper stopper 20*b* of the auxiliary pressure generating member and the upper surface of the pressure plate 13; thus, the upper stopper 20*b* of the auxiliary pressure generating member and the pressure plate 13 are not engaged; therefore, the auxiliary pressure generating member 20 itself is not subjected to the tensile stress of the pressure generating spring 21.

Also in the pressure generating state, the set spring 16 must generate a tensile force strong enough for holding stably the positional relation between the pressure plate 13 and frame 1 after pulling down the pressure plate 13 to the stopper 19, the uppermost portion of the side plate 2. However, when the illustrated moment is taken into consideration, the force generated by the set spring 16 need only be larger than substantially half the force generated by the compression spring 21. Further, the guide stay 9 and pressure roller 4 are stably pressed to each other with a predetermined contact pressure generated by a predetermined amount of the compressive displacement of the pressure generating spring 21.

In the apparatus of this embodiment, the auxiliary pressure generating member 20, pressure generating spring 21, rotational axis 14 of the pressure plate, and set spring 16 are provided at each of the front and rear sides of the apparatus so that the pressure applied to the sheet fed into the apparatus becomes uniform across the sheet.

A reference numeral 22 designates a sheet guide attached to the apparatus frame 1; 23, a post-fixation top guide attached to the bottom guide attached to the bottom surface of the pressure plate 13. Each of these members extends in the direction perpendicular to this page, that is, the front to rear direction of FIG. 2, across the width of the sheet fed into the apparatus.

A reference numeral 25 designates a power supply connector for the heater 11. As the power is supplied to the heater 11 through this connector 25, the heater 11 generates heat. The temperature of the heater 11 is controlled at a predetermined one by an unshown temperature control system.

The gear 8 affixed to one end of the pressure roller 4 is engaged with the gear (unshown) of the driving system provided in the main assembly of the image forming apparatus, and as it is rotated in the counterclockwise direction in FIG. 2 at a predetermined peripheral velocity, the tube of film 12 is rotated around the internal film guide stay 9 because of the surface friction between the pressure roller 4 and the film 12, sliding on the surface of the heater 11 while maintaining firm contact with the surface.

While the film 12 is rotated by the rotation of the pressure roller 4 and the heater 11 is generating the heat, a sheet material P carrying an unfixed toner image on its upper surface is delivered from an unshown processing means for image formation and is introduced by the sheet material guiding member 22 into the fixing nip N, between the rotating film 12 and pressure roller 4.

The sheet material P introduced into the fixing nip N is passed through the fixing nip N, together with the film 12, while remaining firmly in contact with the surface of the rotating film 12, and as the sheet material P passes through the fixing nip N, the thermal energy from the heater 11 is transmitted to the sheet material P through the film 12, whereby the toner image is thermally fixed onto the sheet material P.

When the pressure generated in the fixing N needs to be released in order to take core of the jam or the like problem, the handle 15 of the pressure plate 13 is grasped and pulled up against the tension of the set springs 16 and 16, away from the top edge of the side plate 2 of the frame 1 to the position indicated by the solid line in FIG. 1(*b*), in a manner so as to pivot about the rotational axis 14.

As the pressure plate 13 rotates upward in this manner, the upper surface of the pressure plate 13 becomes engaged with the bottom surface of the upper stopper 22 of the auxiliary pressure generating member 20 at the beginning of the rotation, and then, as the upward rotation of the pressure plate 13 continues, the auxiliary pressure generating member 20 is pulled upward together with the pressure plate as a result, the bottom stopper 20*c* of the auxiliary pressure generating member 20 becomes separated from the extension 10 of the internal film guide stay 9, neutralizing thereby the compressive force of the pressure generating spring 21 working on the extension 10. In this manner, the pressure generated in the fixing nip N, is released, freeing the internal film guide stay 9 and pressure roller 4 from being pressed to each other and effecting a state in which the guide stay 9 merely sits on the pressure roller 4, imparting only the self weight upon the pressure roller 4; therefore, the sheet material having been seized in the fixing nip N is loosened to simplify the jam handling operation.

In FIG. 1(*a*), when L is the distance between the rotational axis 14 of the pressure plate 13 and the pressure generating spring 21; 2L, the distance between the rotational axis 14 of the pressure plate 13 and the spring hanger 17; 3L, the distance between the rotational axis 14 of the pressure plate 13 and the handle 15; and P is the pressure generated in the fixing nip N by the pressure generating spring 21, the force f needed by the set spring 16 must satisfy:

$$2Lf \geqq PL; \text{ therefore, } f \geqq P/2$$

The force F necessary for releasing the pressure generated in the fixing nip N must satisfy:

$$3LF \geqq 2L_f = LP; \text{ therefore, } F \geqq P/3$$

In other words, the force F required of a use for lifting the handle 15 does not need to be large; it is sufficient as long as it is larger than ⅓ of the pressure generated in the fixing nip N. Therefore, the handle can be operated with use of relatively small force.

Generally speaking, the pressure for a small fixing apparatus is 5 to 6 kg, and in this case, it is evident that the force required of the user is substantially 2 kg. When the pressure is as large as 10 to 20 kg, all that is necessary is to design the handle to be such that the leverage for releasing the pressure becomes larger, or an additional lever mechanism may be provided.

After the jam is handled, the pressure plate 13, having been rotated upward, is lowered to rest on the frame 1, whereby the apparatus in the state illustrated in FIG. 1(*b*) regains the state illustrated in FIG. 1(*a*), that is, the pressure generating state.

In this embodiment, since the guide stay 9 and pressure roller 4 are pressed to each other with the use of the pressure generating spring (compression coil spring) 21, the highly precise compression force such as that in the prior apparatus can be reliably obtained; since the pressure generating spring 21 is held on the pressure plate 13, in a compressed state with use of the auxiliary pressure generating member 20, the pressure generating spring 21 can be handled as a part of an assembled unit, improving thereby the assembly efficiency. Also, the distance by which the pressure plate must be displaced for releasing the pressure can be reduced: since the pressure plate 13 is rotatively supported by the apparatus frame, the force holding down the pressure plate can be reduced, and in addition, the force necessary for releasing the pressure can be further reduced because of the component arrangement according to this embodiment.

Figure 5A:
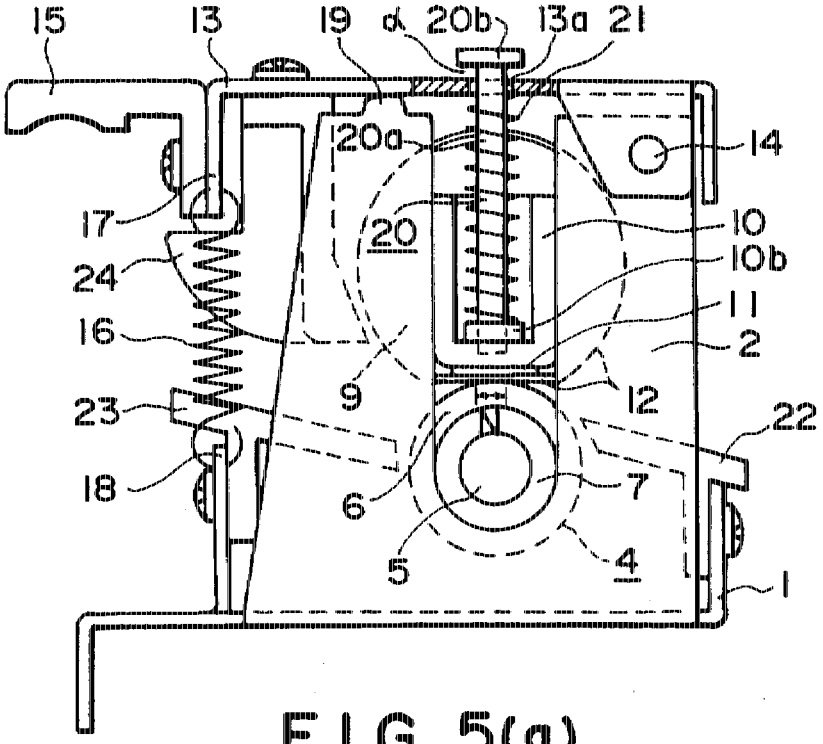
FIGS. 5(*a*) and 5(*b*) are a partially cutaway side view of the second embodiment of the apparatus according to the present invention, and a partially cutaway side view of the apparatus in a state in which the pressure has been released.
Figure 5B:
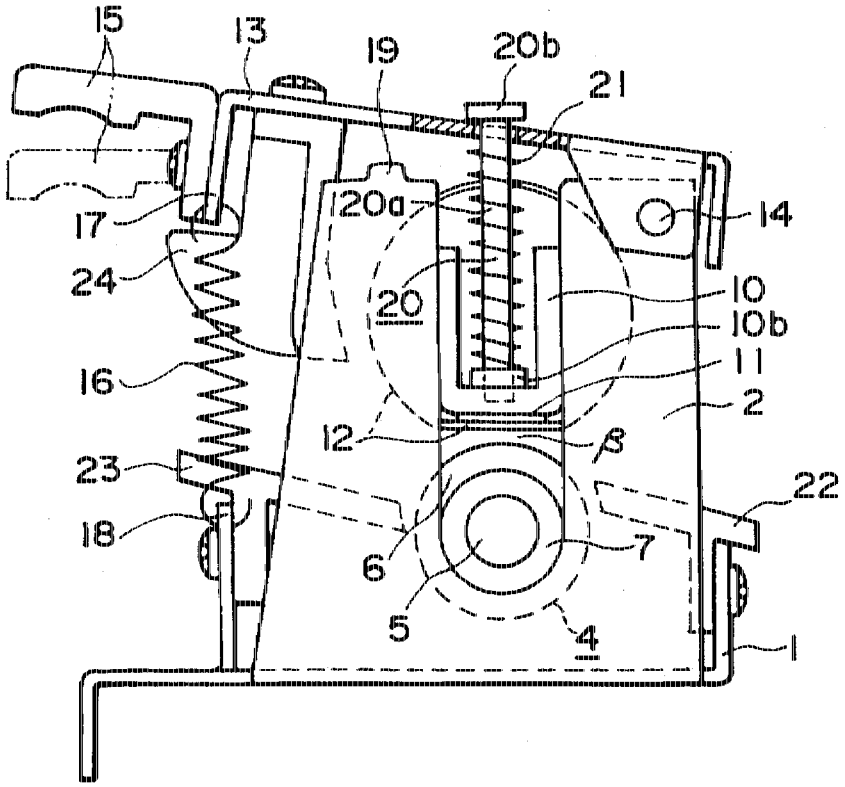
Figure 6:
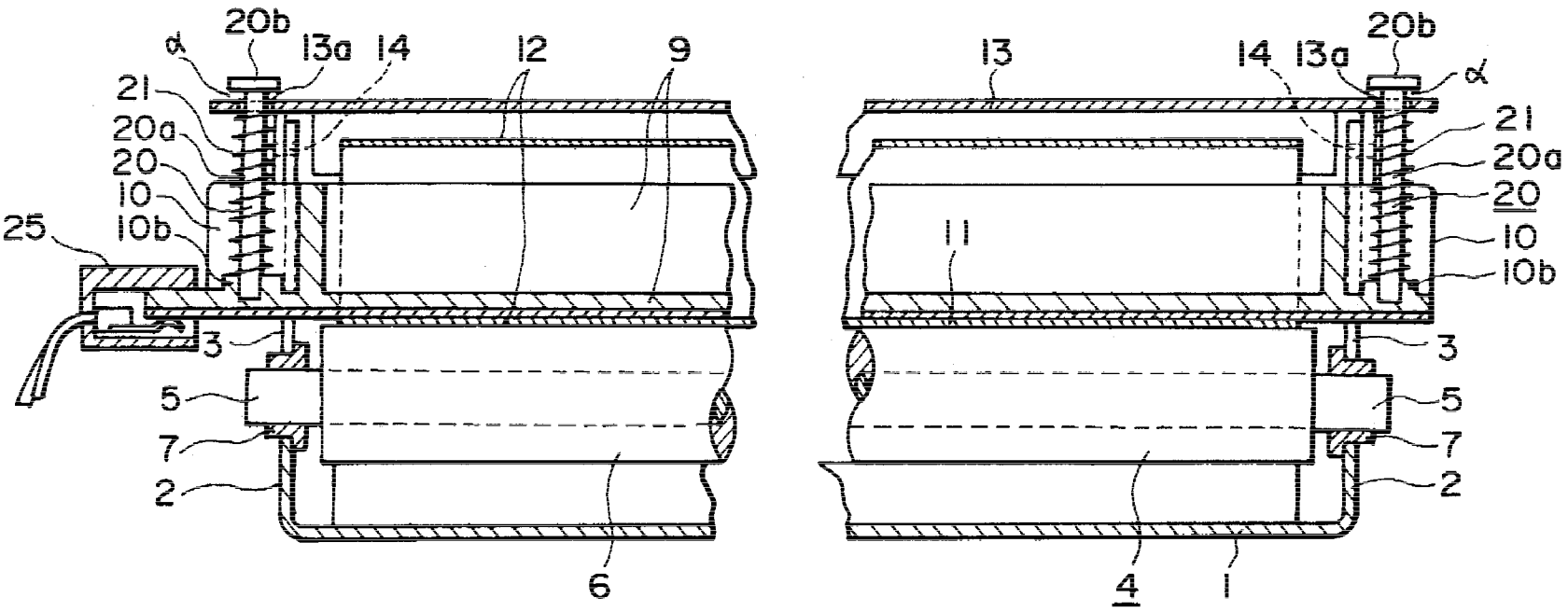
FIG. 6 is a longitudinal section of the rear portion of the apparatus with the middle portion being omitted.

Embodiment 2 (FIGS. 5 and 6)

In Embodiment 1 described hereinbefore, the auxiliary pressure generating members 20 and 20 and the internal film guide stay 9 are separate components, but in this embodiment, the auxiliary pressure generating members 20 and 20 and the guide stay 9 are connected to each other at the bottom of the auxiliary pressure generating member 20. Reference numerals 10*b* and 10*b* designate where they are connected.

The compression state of the apparatus is created in the same manner as in the first embodiment. In this embodiment, in order to release the pressure generated in the fixing nip N, the pressure plate 13 is pulled up against the tension of the set springs 16 and 16 in a manner so as to rotate about the rotational axes 14 and 14, whereby both the auxiliary pressure generating member 20 and guide stay 9 are pulled up as shown in FIG. 5(*b*) because the auxiliary pressure generating member 20 and guide stay 9 are connected; thus, creating a gapβ between the pressure roller 4 and film 12, where the fixing nip N was present. Therefore, the sheet material seized in the fixing nip N is completely freed, allowing the jam to be more efficiently handled.

The auxiliary pressure generating members 20 and 20 are illustrated as integrated portions of the guide stay 9, but in light of the component performance or its assembly efficiency, they do not need to be connected or integrated in this manner; the auxiliary pressure generating member 20 may be differently combined as long as the combination allows both the guide stay 9 and pressure plate 13 to be displaced together, with the auxiliary compressive force of the pressure generating spring 21 remaining on the auxiliary pressure generating member.

Figure 7A:
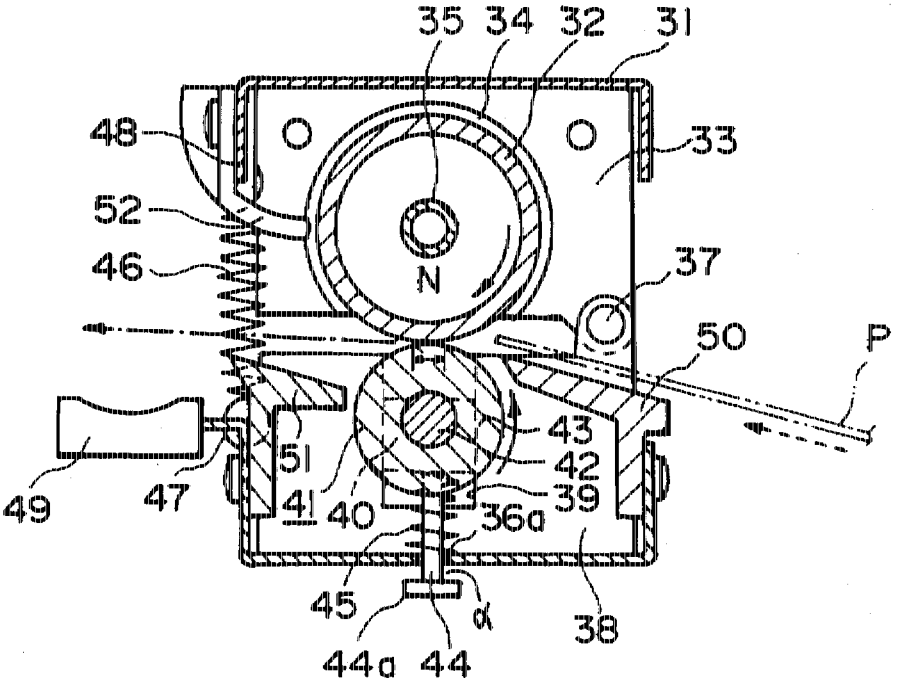
FIGS. 7(*a*) and 7(*b*) are a sectional view of the third embodiment, and a sectional view of the embodiment in a state in which the pressure has been released.
Figure 7B:
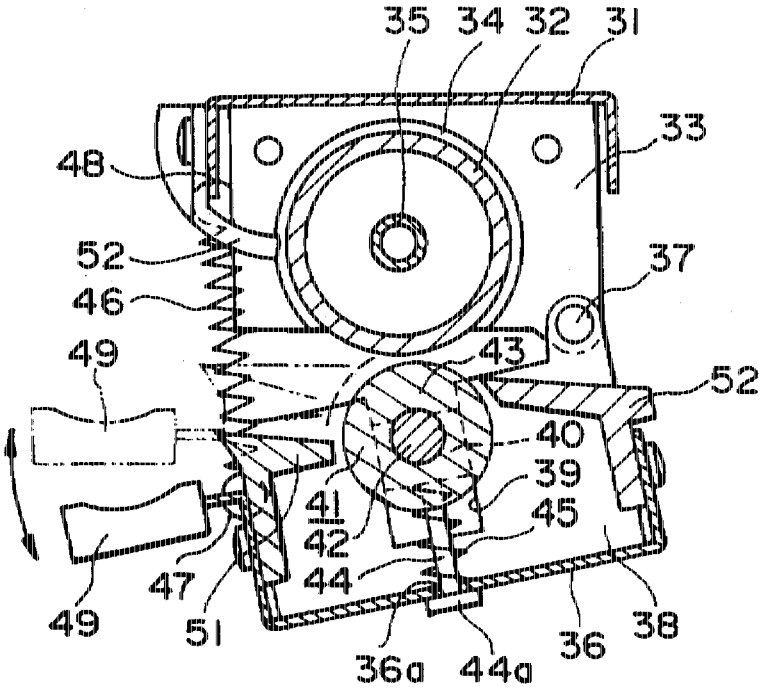

Embodiment 3 (FIG. 7)

This embodiment is an embodiment of the heat roller type apparatus.

A reference numeral 31 designates an apparatus frame. A reference numeral 32 designates a heat roller as the heating means made of aluminum pipe and is rotatively supported between the left and right side plates 33 and 33 of the frame 31 through C-shaped bearings 34 and 34.

A reference numeral 35 designates a halogen heater which is extended through the heat roller 32 and is supported between the left and right side plates 33 and 33 of the frame 31. The heat roller 32 is heated by this halogen heater 35, the temperature of which is controlled at a predetermined one by an unshown temperature control system.

A reference numeral 36 designates a pressure plate connected to the frame 31 with use of rotational axes 37 and 37, whereby it can be rotated downward away from the frame 31 about these axes 37 and 37.

In each of the left and right side plates 38 and 38 of the pressure plate 36, a vertical guide groove 39, which is symmetrical to the one on the other side, is provided,in which a bearing 40 is engaged. The bearing 40 is vertically movable in the guide groove 39.

A reference numeral 40 designates a pressure roller as the opposing means which comprises a metallic rod 42 and a heat resistant rubber material layer 43 and is rotatively supported at both left and right ends by left and right bearings 40 and 40.

Reference numerals 44 and 44 designate shaft rods of the auxiliary pressure generating members constructed integrally with the left and right bearings 40 and 40, on the bottom surfaces. The bottom end of each of the shaft rods is put through the hole 36*a* of the bottom plate of the pressure plate 36, so that is slightly projects out of the bottom plate, and a stopper 44*a* is attached to this projecting end. The diameter of the hole 36*a* is made larger than that of the shaft rod, but the diameter of the stopper 44*a* is made larger than that of the hole 36*a*.

Reference numerals 45 and 45 designate pressure generating springs (compression spring) which are loosely fitted around the left and right shaft rods 44 and 44 of the auxiliary pressure generating members, and are compressed between the bearings 40 and 40 and the bottom plate of the pressure plate 36.

Reference numerals 46 and 46 designate set springs provided on the side opposite to the rotational axes of the pressure plate 36, on the left and right sides of the apparatus, and they are stretched between spring hangers 47 and 47 of the pressure plate 31 side and spring hangers 48 and 48 of the frame 31 side.

A reference numeral 49 designates a handle (operational member for releasing the pressure); 50 and 51, a sheet material guide and a post-fixation bottom guide, respectively, both of which are attached to the pressure plate 36: and 52 designates a post-fixation top guide attached to the frame 31.

When left alone, the positional relation between the pressure plate 36 and frame 31 remains in such a state as shown in FIG. 7(*a*), in which the pressure plate 36 rests on unshown stoppers while being pulled by the tension of the set springs 46 and 46 in a manner so as to rotate about the rotational axes 37 and 37 and close on the frame 31.

In this state, the left and right bearings 40 and 40 are pushed upward along the guide grooves 39 and 39 by the auxiliary pressure generating members 44 and 44 imparted with the expansive pressure of the pressure generating springs 45 and 45; therefore, the pressure roller 41 is pressed on the bottom surface of the heat roller 32 with a predetermined contact pressure. As a result, the heat resistant rubber material layer 42 of the pressure roller 41 is deformed; in other words, the surface of the pressure roller 41 conforms to the contour of the heat roller 42, creating a fixing nip N having a predetermined width. The apparatus maintains the pressure generating state in this manner.

The heat roller 32 is rotated by an unshown driving system in the clockwise direction at a predetermined peripheral velocity, and the pressure roller 41 is rotated by the rotation of the heat roller 32.

In a state in which the heat roller 32 has been heated to a predetermined temperature and is being rotated, a sheet material P carrying an unfixed toner image on the upper surface is delivered from an unshown processing means for image formation, and is introduced as the member to be heated into the fixing nip N by the guide 50, and while it is sandwiched in the nip N and passed through it, the toner image is thermally fixed.

When the pressure generated in the fixing nip N needs to be released in order to take care of the jam, all that is needed is to grasp the handle 49 of the pressure plate 36 and push it down against the tension of the set springs 46 away from the frame 31 to the position indicated by the solid line in FIG. 7(*b*), in a manner to rotate about the rotational axes 37 and 37.

As the pressure plate 36 is pivoted downward in this manner, the bottom plate of the pressure plate 36 becomes engaged with each of the bottom stoppers 44*a* and 44*a* of the respective left and right auxiliary pressure generating members 44 and 44 at the beginning of the downward movement, and then, as the downward rotation of the pressure plate 36 is continued, the auxiliary pressure generating members 44 and 44, that is, the bearings 40 and 40 and the pressure roller 41, are pushed down, together with the pressure plate 36, away from the frame 31 as shown in FIG. 1(*b*); thus, the force pressing the heat roller 32 and pressure roller 41 to each other, that is the pressure generated in the fixing nip N, is released.

The relations among the pressure generated by the pressure generating springs 45 and 45, the tension generated by the set springs 46 and 46, and the force necessary for operating the handle to release the pressure is the same as that in the first embodiment.

After the jam is taken care of, the apparatus in the state shown in FIG. 7(*b*) returns to the state shown in FIG. 7(*a*), as the pressure plate 36 having been rotated in the opening direction is let rotate in the closing direction to come to rest on the frame 31.

As described hereinbefore, in the heating apparatus according to the present invention, in which the material to be heated is heated by being sandwiched between the heating means and opposing means which are pressed to each other by the pressing member, a stable contact pressure can be obtained between the heating means and opposing means; the pressure can be released with use of the least amount of force and with the least amount of component displacement in spite of the simple structure. Therefore, the operational efficiency itself in releasing the pressure during the jam handling operation can be improved.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a first member;

a second member for forming a nip in cooperation with said first member;

a first frame for supporting said first member;

a second frame connected to said first frame for rotation about a rotational axis;

a first elastic member having an elastic force for pressing said second member toward said first member from said second frame; and a second elastic member for imparting pressure between said first frame and said second frame to increase the elastic force of said first elastic member, said second elastic member being located at a position away from said first elastic member in a direction away from said rotational axis.

2. An apparatus according to claim 1, wherein said first elastic member and second elastic member are spring members.

3. An apparatus according to claim 1, further comprising a lever for releasing the pressure between said first elastic member and said second elastic member.

4. An apparatus according to claim 1, wherein said second member constitutes a heater used in a stationary state, and said heater forms a nip in cooperation with said first member, with a film which moves with a recording material being interposed.

5. An image heating apparatus comprising:

a first member;

a second member for forming a nip in cooperation with said first member;

a first frame for supporting said first member;

a second frame connected to said first frame for rotation about a rotational axis;

a first elastic member for pressing said second member toward said first member from said second frame;

a second elastic member for imparting pressure between said first frame and said second frame to increase elastic force of said first elastic member; and a lever for releasing the pressure between said first elastic member and said second elastic member, said lever being located at a position away from said second elastic member in a direction away from said rotational axis.

6. An apparatus according to claim 5, wherein said second elastic member is located across said first elastic member from said rotational axis.

7. An apparatus according to claim 5, wherein said first elastic member and second elastic member are spring members.

8. An apparatus according to claim 5, wherein said second member constitutes a heater used in a stationary state, and said heater forms a nip in cooperation with said first member, with a film which moves with a recording material being interposed.

9. An image heating apparatus comprising:

a first member;

a second member for forming a nip in cooperation with said first member;

a first frame for supporting said first member;

a second frame connected to said first frame for rotation about a rotational axis;

a first elastic member for pressing said second member toward said first member from said second frame; and a second elastic member for imparting pressure between said first frame and said second frame.

10. An apparatus according to claim 9, wherein said first elastic member and second elastic member are spring members.

11. An apparatus according to claim 9, wherein said second member constitutes a heater used in a stationary state, and said heater forms a nip in cooperation with said first member, with a film which moves with a recording material being interposed.

12. An apparatus according to claim 1, 5, or 9, wherein said second frame is contacted to said first elastic member to bear against elastic force.

13. An apparatus according to claim 1, 5, or 9, wherein said first frame is fixed.

14. An apparatus according to claim 4, 8, or 11, wherein said first member includes a roller.

15. An apparatus according to claim 14, wherein said roller is a driving roller.

16. An apparatus according to claim 1, 5, or 9, wherein said first member includes a heating roller, and said second member includes a pressing roller.

17. An apparatus according to claim 1, 5, or 9, wherein a recording material carrying an unfixed image is fed up by said nip, and the unfixed image is fixed by the feeding through the nip.

* * * * *

UNITED STATES PATENT AND TRADEMARK OFFICE

CERTIFICATE OF CORRECTION

PATENT NO. : 5,708,926
DATED : January 13, 1998
INVENTOR(S) : Seiji SAGARA, et al.

It is certified that error appears in the above-identified patent and that said Letters Patent is hereby corrected as shown below:

Title Page, [56] References Cited, delete "Nakatoni" and insert therefor --Nakatomi--;
[57] Abstract, line 3, delete "frame a" and insert therefor --frame; a --.
Line 4, delete "frame", second occurrence, and insert therefor --for--.

Column 3, line 4, delete "reduced" and insert therefor --reduce--.

Column 4, line 57, after "13", insert a comma (",").

Column 5, line 22, delete "beat" and insert therefor --heat--.

Column 6, line 32, delete "core" and insert therefor --case--.

Column 7, line 56, delete "gap$\beta$" and insert therefor --gap $\beta$--.

UNITED STATES PATENT AND TRADEMARK OFFICE

CERTIFICATE OF CORRECTION

PATENT NO. : 5,708,926

DATED : January 13, 1998

INVENTOR(S) : Seiji SAGARA, et al.

It is certified that error appears in the above-indentified patent and that said Letters Patent is hereby corrected as shown below:

Column 8, line 36, delete "is" and insert therefor --it--.

Signed and Sealed this

Twenty-eighth Day of July, 1998

Bruce Lehman

*Attest:*

BRUCE LEHMAN

*Attesting Officer*

*Commissioner of Patents and Trademarks*